United States Patent [19]

Ng

[11] Patent Number: 5,074,324

[45] Date of Patent: Dec. 24, 1991

[54] METHOD AND APPARATUS FOR REDUCING DRAG AND NOISE ASSOCIATED WITH FLUID FLOW IN A CONDUIT

[75] Inventor: Kam W. Ng, Barrington, R.I.

[73] Assignee: The United States of America as represented by the Secretary of the Navy, Washington, D.C.

[21] Appl. No.: 729,743

[22] Filed: Jul. 12, 1991

[51] Int. Cl.[5] ..... F17D 1/20

[52] U.S. Cl. ..... 137/13; 138/121; 137/803

[58] Field of Search ..... 137/13, 803; 138/121, 138/122

[56] References Cited

U.S. PATENT DOCUMENTS 3,099,993 8/1963 Smith ..... 137/13
3,143,124 8/1984 Todd ..... 137/13
4,462,429 7/1984 Coursen ..... 137/13 X
4,852,616 8/1989 Holcomb ..... 138/121 X

*Primary Examiner*—Alan Cohan
*Attorney, Agent, or Firm*—Michael J. McGowan; Prithvi C. Lall; Michael F. Oglo

[57] ABSTRACT

A method and apparatus for reducing drag and noise associated with fluid flow within a conduit is provided. The conduit has flexible walls that are shaped to form stationary waves having peaks and troughs and are repeated in the axial direction of the conduit. The stationary waves are moved along the axial direction of the conduit whereby a vortex is trapped in the fluid flow at each of the troughs. Each of the vortices forms part of an isolating layer between the conduit wall and the main stream of the fluid flow thereby reducing drag. Furthermore, the vortices push the dominant noise producing region toward the center of the fluid flow where sound coupling efficiency is lower.

16 Claims, 2 Drawing Sheets

METHOD AND APPARATUS FOR REDUCING DRAG AND NOISE ASSOCIATED WITH FLUID FLOW IN A CONDUIT

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to drag and noise associated with a fluid flow and more particularly to a method and apparatus that reduces drag and noise associated with fluid flow in a conduit.

(2) Description of the Prior Art

Drag and noise reduction associated with a fluid flow in a conduit has always been a concern for a variety of reasons. Basically, drag between the fluid and internal conduit walls causes a pressure loss leading to increased power consumption. Similarly, the flow noise generated within the conduit may adversely affect the surroundings as well as the individuals working therein.

Accordingly, several prior art systems have been developed to reduce drag and/or flow noise. For example, long-chain polymer solutions have been injected into a fluid flow to reduce the fluid's viscosity (drag). However, this is not always practicable since the fluid being transported may need to be kept free from such contamination. Furthermore, the performance of such a polymer solution is generally subject to degradation over time.

Another possible prior art drag reduction method involves the injection of microscopic air bubbles along the inside walls of the conduit thereby introducing a thin layer of air between the conduit walls and the fluid flow to reduce drag therebetween. However, the use of the "micro" bubbles has not proven to be an effective method of drag reduction as experimental results are not conclusive. Furthermore, neither the polymer solution injection nor the micro bubble injection (drag reduction) approach is concerned with the simultaneous reduction of flow noise.

One prior art method that does attempt to reduce drag and flow noise simultaneously is known as flow path streamlining. However, because this often involves redesigning and modifying the entire conduit system, it can be costly and difficult to implement. Traditionally, flow noise reduction has been accomplished by lining the inside wall of the conduit with sound absorbent materials or, alternatively, reducing the velocity of the fluid flow. However, use of absorbent materials may be limited by space constraints in certain system configurations while reduction in flow velocity is not a desirable tradeoff.

SUMMARY OF THE INVENTION

Accordingly, it is an object of the present invention to provide a method and apparatus for simultaneously reducing drag and noise associated with fluid flow in a conduit.

Another object of the present invention is to provide a method and apparatus for simultaneously reducing drag and flow noise that avoids the expense and difficulty associated with flow path streamlining.

Still another object of the present invention is to provide a method and apparatus for simultaneously reducing drag and flow noise in a conduit that does not require the contamination of the fluid with an externally injected substance.

Other objects and advantages of the present invention will become more obvious hereinafter in the specification and drawings.

A method and apparatus for reducing drag and noise associated with fluid flow within a conduit is provided. The conduit has flexible walls that are shaped to form stationary waves having peaks and troughs. The stationary waves repeat in the axial direction of the conduit, have a peak-to-trough amplitude in the range of 0.1 to 0.2 of the conduit's inside diameter and have a wavelength that is approximately equal to the conduit's inside diameter. The stationary waves are then moved along the axial direction of the conduit whereby a stable vortex is trapped in the fluid flow at each of the troughs. Each of the vortices forms part of an isolating layer between the conduit wall and the main stream of the fluid flow thereby reducing drag. Furthermore, the vortices push the dominant noise producing region toward the center of the fluid flow where sound coupling efficiency is lower.

BRIEF DESCRIPTION OF THE DRAWING(s)

FIG. 1(*b*) is a cross-sectional view along the axial direction of the circumference of the conduit of FIG. 1(*a*);

FIG. 4(*b*) is a cross-sectional view of a conduit configured coannular flow in another application of the present invention.

DESCRIPTION OF THE PREFERRED EMBODIMENT(s)

Figure 1A:
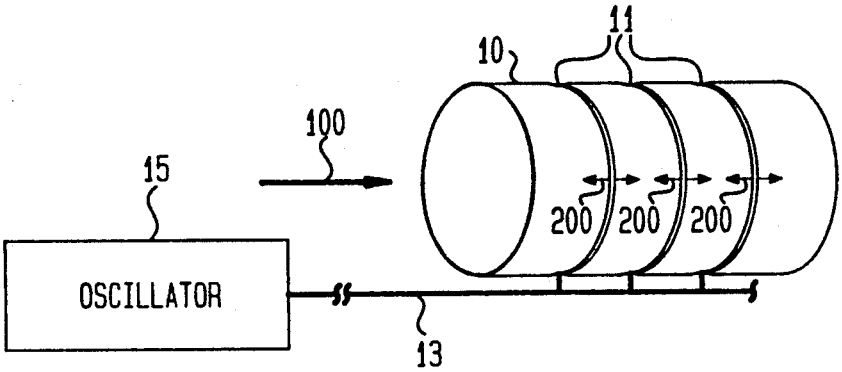
FIG. 1(*a*) is a perspective view of a section of fluid carrying conduit in one embodiment of the present invention.
Figure 1B:
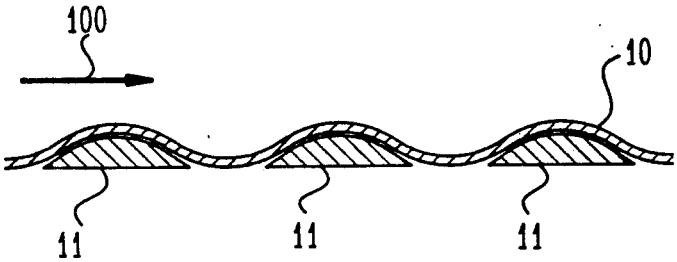

Referring now to the drawings, and in particular to FIGS. 1(*a*) and 1(*b*), a first embodiment of the method and apparatus of the present invention will now be described. It is to be understood at the outset that the present invention is not limited to this embodiment. Indeed, several other embodiments will be described hereinbelow without departing from the scope of the present invention.

In FIG. 1(*a*) a section of pipe or conduit 10 is shown for carrying a fluid flow that is indicated by arrow 100. Conduit 10 has a plurality of evenly spaced rings 11 wrapped about its circumference. The length of the section wrapped with rings 11 is selected based on the desired flow noise and drag reduction and can include the entire length of the conduit. Rings 11 are disposed about conduit 10 such that each ring 11 squeezes conduit 10 to reduce the inside diameter of conduit 10 at each ring 11. Accordingly, conduit 10 must be made from flexible material to permit the deformity. Some flexible materials which may be utilized for conduit 10 include rubber, elastomers and other compliant materials. Rings 11 are typically made of metallic materials, i.e., steel, alloys and various other metals. However, other high strength and rigid materials such as composites may also be employed.

An oscillating belt or bar 13 is provided to fixably connect each ring 11 whereby oscillating movement of bar 13 generated by an oscillator 15 translates into an oscillating movement of rings 11 along the axial direction of conduit 10. The choice of system (i.e., the oscillating bar 13 and oscillator 15) used to move rings 11 in the aforementioned oscillating fashion is a design consideration not meant to be a limitation on the present invention.

In order to better visualize the squeezing effect on conduit 10, a cross-sectional view taken along the axial direction of the circumference of conduit 10 is shown in FIG. 1(*b*). As shown, it is obvious that each ring 11 has an inside diameter that is less than the outside diameter of conduit 10. Accordingly, the flexible walls of conduit 10 are shaped to form a stationary and repeating sine (or cosine) wave as seen by fluid flow 100.

The profile of the stationary sine wave should be such that its peak-to-trough amplitude is in the range of 0.1 to 0.2 of the inside diameter of conduit 10. In addition, the wavelength of each stationary sine wave is approximately equal to the inside diameter of conduit 10.

As fluid flow 100 moves through conduit 10, oscillating bar 13 is oscillated back and forth in the axial direction of conduit 10 as indicated by arrows 200 of FIG. 1(*a*). Thus, the stationary sine wave as seen by fluid flow 100 is translated into a traveling wave having a velocity or phase speed w along the axial direction of conduit 10 and in the same direction of fluid flow 100.

Figure 2:
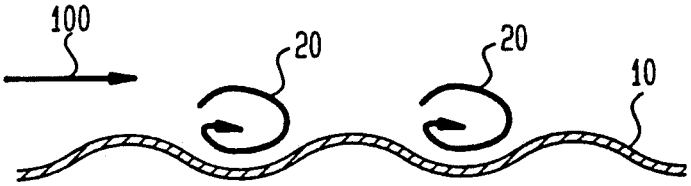
FIG. 2 is an enlarged and isolated view of the flexible wall conduit shaped to carry out the method of the present invention.

The mechanism of drag and flow noise reduction will now be described with reference to FIG. 2 where the flexible wavy wall shaped conduit 10 of FIG. 1(*b*) is enlarged and shown in isolation for purposes of clarity. The generated traveling wave causes vortices 20 to be formed at the troughs of the shaped conduit 10. By adjusting the speed w of the traveling wave with respect to the mean velocity U of the fluid flow 100, vortices 20 can be trapped in the troughs to appear stable and fixed with respect to fluid flow 100. With respect to two-dimensional flow, this phenomena has previously been well documented in "Preliminary Study of Nonlinear Flow Over Traveling Wavy Wall", by J. M. Wu et al, The University of Tennessee Space Institute, Tullahoma, Tenn., and is incorporated herein by reference. It as been found that such stable vortices occur when the ratio of the traveling wave speed w to the mean velocity U of fluid flow 100 is in the range of 0.25 to 0.5 (i.e., $w/U=0.25$ to 0.5).

The creation of these stable vortices 20 is crucial to the drag reduction provided by the present invention. The individual vortices 20 act like a row of roller bearings that cushions and separates flow 100 from the wall of conduit 10. Accordingly, an isolating layer (formed by the row of vortices 20) is formed between the conduit 10 and the main stream of fluid flow 100 thereby providing zero pressure drag between the two. Thus, the method and apparatus of the present invention is able to convey the fluid within conduit 10 at a reduced power consumption.

The above described method and apparatus simultaneously reduces the noise associated with fluid flow 100. Typically, flow noise is a function of velocity fluctuations of the fluid flow 100 due to the shear or mixing layer formed at the boundary (i.e., the inside wall) of conduit 10 and fluid flow 100. In particular, it has been shown that the flow noise is a function of: 1) the mean velocity of fluid flow 100 in the axial direction of conduit 10, 2) the fluctuating velocity of fluid flow 100 in the radial direction of conduit 10, and 3) Green's function. (See "Fluctuating Wall Pressure and Vibratory Response of a Cylindrical Elastic Shell Due to Confined Jet Excitations", K. W. Ng, Ph. D. Thesis, University of Rhode Island, 1988, incorporated herein by reference.) Since the greatest amount of velocity fluctuation occurs in the mixing layer along the boundary of conduit 10 and fluid flow 100, the greatest amount of flow noise is generated along that boundary. However, the creation of vortices 20 push the mixing layer away from the inside wall of conduit 10 thereby pushing the dominant noise producing region toward the center of fluid flow 100 where the sound coupling efficiency is lower.

Figure 3:
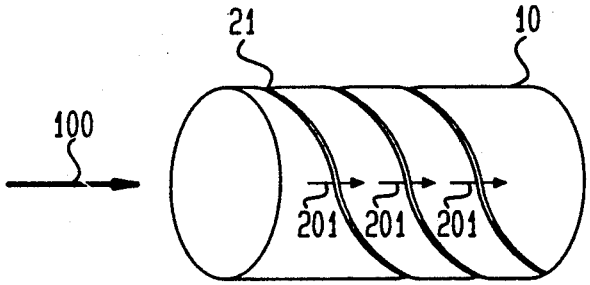
FIG. 3 is a perspective view of a section of fluid carrying conduit in another embodiment of the present invention.

As initially indicated, the present invention may be practiced by a variety of physical embodiments. For instance, the plurality of evenly spaced rings may be replaced by a single helical element 21 wrapped around conduit 10 as shown in the section view of FIG. 3. Similar to the rings 11, helical element 21 is tensioned to squeeze conduit 10 to form stationary sine waves having the same peak-to-trough amplitude and wavelength characteristics described above. Note that a cross-sectional view taken anywhere along the axial direction of the circumference of conduit 10 will yield a stationary sine wave (as viewed by fluid flow 100) that is identical to that shown in FIG. 1(*b*). In this embodiment, helical element 21 is rotated about the axis of conduit 10 by a driving mechanism (not shown). This generates the traveling wave progressing in the axial direction of the conduit in the downstream direction of fluid flow 100 as indicated by arrows 201 of FIG. 3. The resulting traveling wave speed characteristics and mechanism for reducing drag and flow noise are identical to that described above.

Figure 4A:
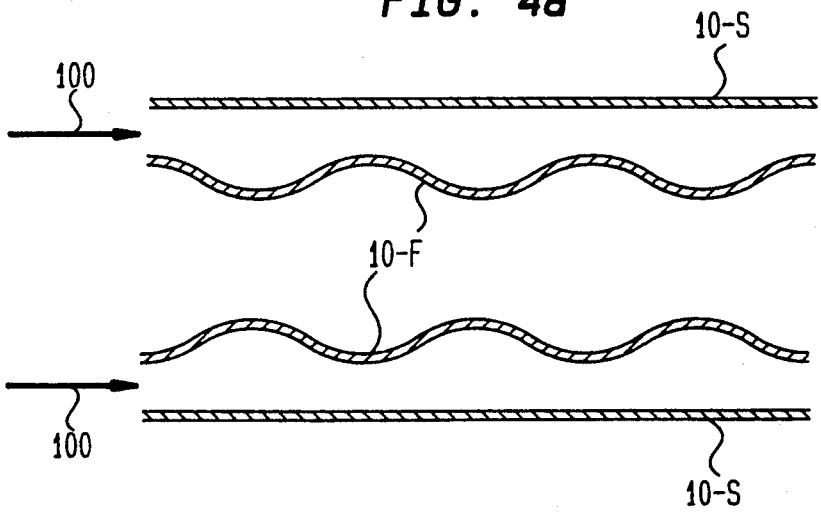
FIG. 4(*a*) is a cross-sectional view of a conduit configured for coannular flow in an application of the present invention.
Figure 4B:
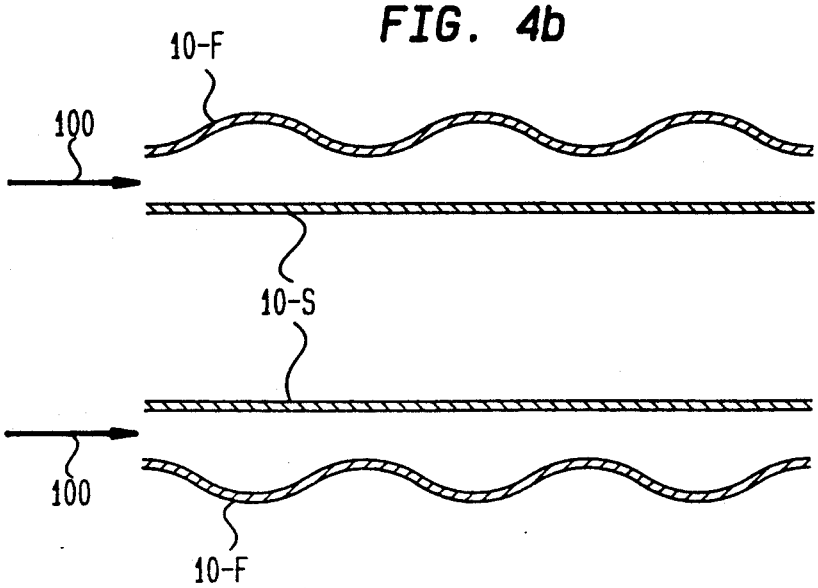

In yet another embodiment, the present invention can be applied to coannular flow situations as depicted in the cross-sectional view of FIG. 4(*a*) and 4(*b*). In FIG. 4(*a*), a straight outer conduit 10-s is provided around a flexible wall inner conduit 10-*f*. In FIG. 4(*b*), a flexible wall outer conduit 10-*f* is provided around a straight wall inner conduit 10-s. In either case, fluid flow 100 occurs between the straight and flexible wall conduits 10-*s* and 10-*f*, respectively. Note that for purposes of clarity, the apparatus for creating the stationary sine wave and for moving same have been omitted. However, either the rings 11 or helical element 21 may be used to squeeze the flexible wall conduit as described above. Also, in either case, the inside diameter of the innermost conduit (10-*f* in FIG. 4(*a*) and 10-*s* in FIG. 4(*b*)) is used to determine the amplitude and wavelength of the created wave.

Examples of coannular flow include the movement and transportation of bodies or vehicles in a conduit, swimout of torpedoes in a torpedo tube and various other flow configurations in piping systems.

The advantages of the present invention are numerous. The disclosed method and apparatus provide a combined drag and flow noise reduction system for a fluid carrying conduit. No contamination of the fluid by air or liquid is required. The present invention will find great utility in any piping system where power consumption and/or flow noise problems are of concern.

Accordingly, the method and apparatus may be used by industrial, power, chemical or food processing plants, in water supply lines, oil pipelines and marine vessels. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method of reducing drag and noise associated with a fluid flow within a conduit having flexible walls, comprising the steps of:

shaping the flexible walls of the conduit to form stationary waves having peaks and troughs, the stationary waves being repeated in the axial direction of the conduit, wherein a peak-to-trough amplitude is in the range of 0.1 to 0.2 of the conduit's inside diameter and wherein the wavelength of each stationary wave is approximately equal to the conduit's inside diameter; and moving the stationary waves in the axial direction of the conduit whereby a stable vortex is trapped in the fluid flow at each of the troughs.

2. A method as in claim 1 wherein said step of shaping comprises the step of squeezing the flexible wall conduit about its circumference with a plurality of evenly spaced rings to form the stationary waves.

3. A method as in claim 2 wherein said step of moving the stationary waves comprises the step of oscillating the rings back and forth along the axial direction of the conduit

4. A method as in claim 3 wherein the stationary waves are moved at a speed that is in the range of 0.25 to 0.5 of a mean velocity of the fluid flow.

5. A method as in claim 1 wherein said step of shaping comprises the step of squeezing the flexible wall conduit about its circumference with a helical element to form the stationary waves.

6. A method as in claim 3 wherein said step of moving the stationary waves comprises the step of rotating the helical element about the axis of the conduit.

7. A method as in claim 5 wherein the stationary waves are moved at a speed that is in the range of 0.25 to 0.5 of a mean velocity of the fluid flow.

8. A method of reducing drag and noise associated with a fluid flow within a conduit having flexible walls, comprising the steps of:

shaping the flexible walls of the conduit to form stationary waves having peaks and troughs, the stationary waves being repeated in the axial direction of the conduit, wherein a peak-to-trough amplitude is in the range of 0.1 to 0.2 of the conduit's inside diameter and wherein the wavelength of each stationary wave is approximately equal to the conduit's inside diameter; and generating traveling waves from the stationary waves, the traveling waves moving in the axial direction of the conduit whereby a stable vortex is trapped in the fluid flow at each of the troughs of the traveling waves.

9. A method as in claim 8 wherein said step of shaping comprises the step of squeezing the flexible wall conduit about its circumference with a plurality of evenly spaced rings to form the stationary waves.

10. A method as in claim 9 wherein said step of generating traveling waves comprises the step of oscillating the rings back and forth along the axial direction of the conduit

11. A method as in claim 8 wherein said step of shaping comprises the step of squeezing the flexible wall conduit about its circumference with a helical element to form the stationary waves.

12. A method as in claim 11 wherein said step of generating the traveling waves comprises the step of rotating the helical element about the axis of the conduit

13. A method as in claim 8 wherein the traveling waves are moved at a speed that is in the range of 0.25 to 0.5 of a mean velocity of the fluid flow.

14. An apparatus for reducing drag and noise associated with a fluid flow within a conduit having flexible walls, comprising:

shaping means in cooperation with the flexible walls of the conduit for forming stationary waves having peaks and troughs, the stationary waves being repeatable in the axial direction of the conduit, wherein a peak-to-trough amplitude is in the range of 0.1 to 0.2 of the conduit's inside diameter and wherein the wavelength of each stationary wave is approximately equal to the conduit's inside diameter; and moving means in cooperation with said shaping means for driving the stationary waves in the axial direction of the conduit whereby a stable vortex is trapped in the fluid flow at each of the troughs.

15. An apparatus as in claim 14 wherein said shaping means comprises a plurality of evenly spaced rings, said rings having an inside diameter that is less than the outside diameter of the conduit to squeeze the flexible walls of the conduit to form the stationary waves.

16. An apparatus as in claim 14 wherein said shaping means comprises a helical element, said helical element having an inside diameter that is less than the outside diameter of the conduit to squeeze the flexible walls of the conduit to form the stationary waves.

* * * * *